United States Patent [19]

Heinol

[11] Patent Number: 4,457,458

[45] Date of Patent: Jul. 3, 1984

[54] DISPENSING CAP

[75] Inventor: Alois R. Heinol, Bensenville, Ill.

[73] Assignee: Knight Engineering & Molding Co., Arlington Heights, Ill.

[21] Appl. No.: 441,481

[22] Filed: Nov. 15, 1982

[51] Int. Cl.[3] ..... B65D 25/40; B65D 43/24

[52] U.S. Cl. ..... 222/498; 222/545; 222/556; 220/335; 215/235; 16/227; 16/DIG. 13

[58] Field of Search ..... 220/335, 339; 215/235; 16/225, 227, 286, DIG. 13; 222/498, 511, 517, 537, 540, 543, 545, 550, 556

[56] References Cited

U.S. PATENT DOCUMENTS

| | | | |
|---|---|---|---|
| 3,240,405 | 3/1966 | Abbott | 222/543 |
| 3,419,198 | 12/1968 | Pettersen | 220/339 X |
| 3,741,447 | 6/1973 | Miles et al. | 222/517 |
| 3,933,271 | 1/1976 | McGhie | 220/335 |
| 4,022,352 | 5/1977 | Pehr | 222/153 |
| 4,124,151 | 11/1978 | Hazard | 222/498 |
| 4,193,519 | 3/1980 | Dubach et al. | 222/517 X |
| 4,209,100 | 5/1980 | Uhlig | 215/216 |
| 4,220,248 | 9/1980 | Wilson et al. | 215/235 |
| 4,244,495 | 1/1981 | Lorscheid et al. | 222/153 |
| 4,261,486 | 4/1981 | Bush et al. | 222/517 |
| 4,298,146 | 11/1981 | Montgomery | 222/536 |

FOREIGN PATENT DOCUMENTS

| | | | |
|---|---|---|---|
| 2041891 | 9/1980 | United Kingdom | 222/556 |

*Primary Examiner*—Joseph J. Rolla
*Assistant Examiner*—Michael S. Huppert
*Attorney, Agent, or Firm*—Kinzer, Plyer, Dorn & McEachran

[57] ABSTRACT

A dispensing cap for a container. The cap has a tubular body of circular transverse cross-section with a wall closing the top end of the tubular body. An upwardly opening slot is formed in the top end wall and extends across the tubular body with a generally flat wall forming the bottom of the slot. An aperture extends through the bottom of the slot into an area surrounded by the tubular body. A hinge assembly is located in the slot and includes an upstanding member formed on the flat bottom wall of the slot at a location inwardly of the circular perimeter of the tubular body. A flap is integrally connected to the upstanding member of the hinge assembly by a strap. A portion of reduced thickness is formed in the strap to create a hinge at the juncture of the strap and the upstanding member. The portion of the reduced thickness of the strap is formed by an inclined slot cut in the tubular body near the top end wall and extending into the upstanding member. Inclined ramp surfaces are formed at opposite ends of the upstanding member and corresponding aligned projections are formed on the flap. The projections engage the ramp surfaces during a selected arc of travel of the flap to retard the flap in that position.

4 Claims, 4 Drawing Figures

Fig. 1.
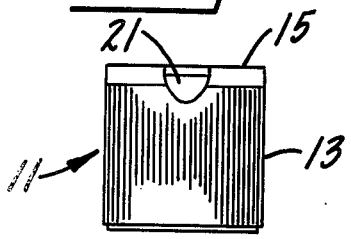
Fig. 2.
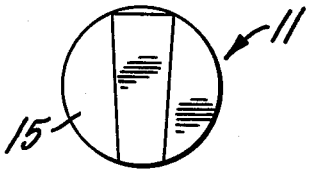
Fig. 3.
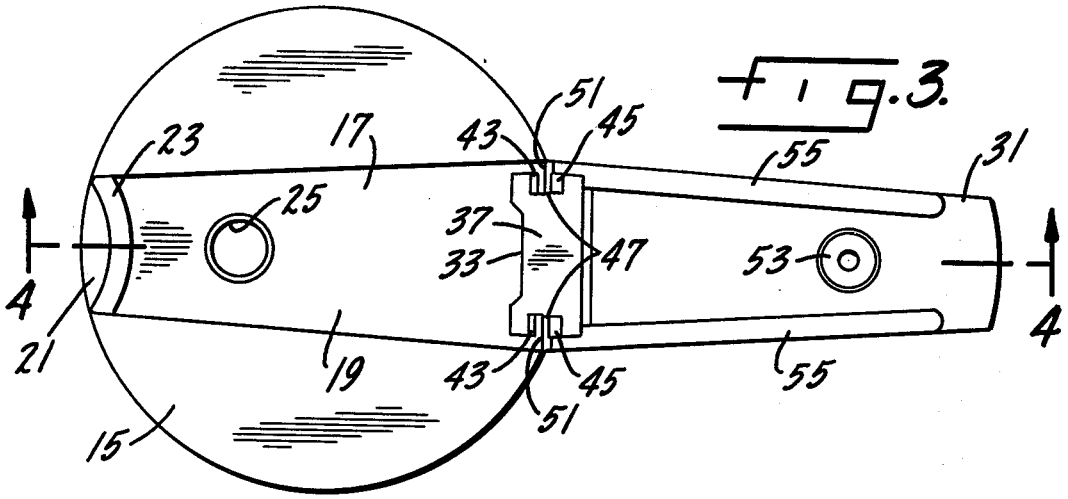
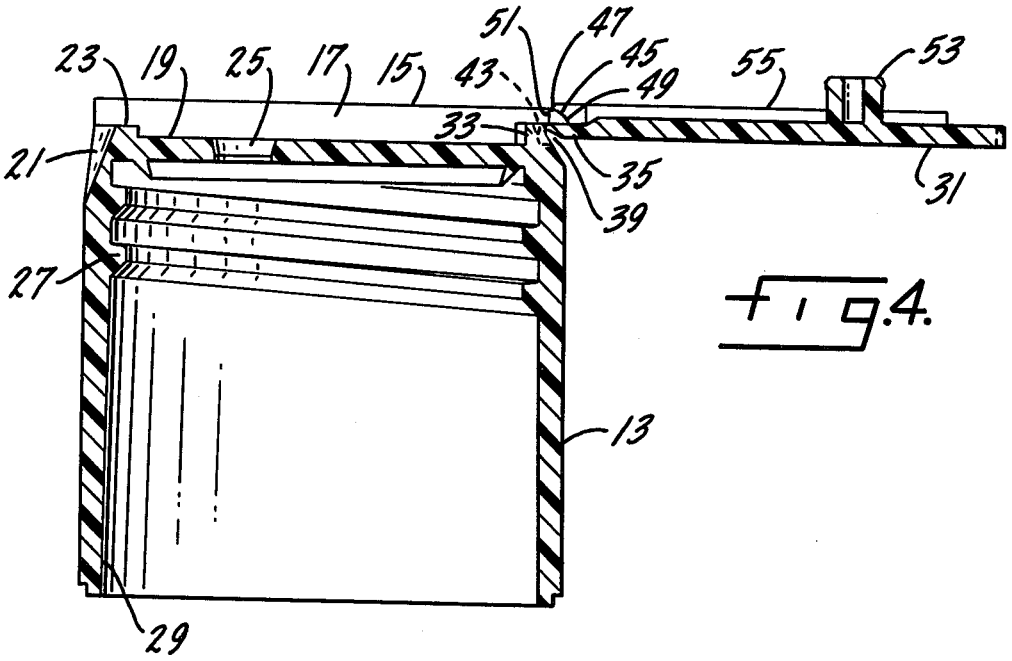
Fig. 4.

DISPENSING CAP

BACKGROUND AND SUMMARY OF THE INVENTION

This invention is concerned with an injection molded dispensing cap which can be attached to the spout of a container for dispensing both liquids and granular solids.

An object of this invention is an injection molded dispensing cap that can be molded in one piece.

Another object of this invention is an injection molded dispensing cap having no projecting parts that could damage an automatic capping mechanism which applies the caps to the spout of a container.

Another object of this invention is a one piece injection molded cap having a flap connected to the cap by a living hinge which is located inwardly of the periphery of the cap.

Another object of this invention is a one piece molded dispensing cap having a flap which, when opened, will stay in an open position where it will not interfere with the flow of material out of the discharge opening of the cap.

BRIEF DESCRIPTION OF THE DRAWINGS

The invention is illustrated more or less diagrammatically in the following drawings wherein:

FIG. 1 is a front elevational view of a dispensing cap of this invention;

FIG. 2 is a top plan view of the cap of FIG. 1;

FIG. 3 is a top plan view on an enlarged scale of the cap shown in the position in which it is molded; and FIG. 4 is a cross sectional view taken along line 4—4 of FIG. 3.

DESCRIPTION OF THE PREFERRED EMBODIMENT

A dispensing cap 11 embodying the novel aspects of this invention is shown in the drawings. The dispensing cap which may be molded of polypropylene or other suitable plastic includes a tubular body 13 of circular cross section closed at one end, an end that will normally be positioned to function as the top of the cap, by a wall 15. A diametrically extending outwardly opening wedge shaped slot 17 is formed in the top wall 15. A flat wall 19 forms the base of the slot. An inclined curved notch 21 cut into the tubular body 13 intersects the base 19 at the smaller end of the slot. A curved raised rim 23 is positioned between the inclined notch 21 and the base 19 of the slot. An aperture 25 extends through the base 19 into an area surrounded by the tubular body 13. This aperture functions as the discharge outlet for the cap. A thread 27 is formed on the inner surface 29 of the tubular body 13.

A flat 31 is formed integrally with the tubular body 13 and is attached to an upstanding member 33 formed on the base 19 of the slot 17 by a relatively short strap member 35. The strap member is reduced in thickness on its underside adjacent the upstanding member 33 to form a living hinge 37. The reduction in thickness of the strap member 35 is accomplished by an inclined groove 39 cut in the outer surface of the tubular body 13. This groove extends into the upstanding member 33 and into the strap member 35 to form the living hinge 37.

Inclined ramps 43 are provided on the upstanding member 33 on opposite sides of the strap member 35. Upstanding projections 45 are formed on the flap 31 on opposite sides of the strap portion 35 and in alignment with the inclined ramps 43. A flat inclined surface 47 is provided near the outer end of each projection and this flat inclined surface engages the inclined ramp 43 on the upstanding member 33 when the flap is moved through a portion of its arc of rotation between the fully open position shown in the drawings of FIGS. 3 and 4 and the closed position of FIGS. 1 and 2. The remaining surface 49 of the projection on the flap side is curved and the surface 51 facing the tubular body is straight so that these surfaces do not contact the inclined ramp 43 during the remaining arc of travel of the flap. A tubular plug 53 is formed on the undersurface of the flap and this plug fits into the discharge aperture 25 formed in the base 19 of the slot 17 to close the aperture tightly when the flap is in its closed position. Strengthening ribs 55 are located on opposite sides of the flap 31.

When the flap 31 is in its closed position in the wedge shaped slot 17, the top of the flap will be flush with the top of the cap wall 15. The end of the flap is accessible to a user placing a finger into the inclined curved notch 21 formed in the side wall of the tubular member. As the flap is lifted, the tubular plug 53 is removed from the aperture 25 allowing material to flow through the aperture. As the flap reaches the position in which the flat inclined surfaces 47 of the projections 45 engage the inclined ramps 43 on the upstanding member 33, the cap will remain in its open position and not will fall back to block the flow of material through the aperture 25. Through the application of additional pressure, however, the flap can be moved to the fully open position shown in FIGS. 3 and 4 and can be returned to its closed position.

Automatic capping machines which are used to apply the caps of this invention to the spout of a container frequently contain a nylon insert to avoid marring the decorative finish of these dispensing caps. However, these nylon inserts can be damaged by any projecting parts on the caps. Thus, an advantage of the dispensing cap of this invention is that the living hinge 37 is located inwardly of the outer circumferential surface of the tubular body 13 of the cap. This is accomplished by the provision of the inclined groove 39 cut in the tubular wall 13 and upstanding member 33 adjacent the hinge connection. By inclining the groove 39, the hinge 37 is formed inwardly of the outer periphery of the cap.

This cap is molded in the open position shown in FIGS. 3 and 4 in a three piece mold having two parting lines. After the mold is closed and the plastic injected into the cavity, the outer mold plate adjacent the flap is open first providing a first parting line. Then the flap 31 is opened 90° from its molded position. A second parting line is made by moving the outer mold plate on the opposite side of the mold away from the center mold plate pulling the flap 31 through the center mold plate. The tubular body 13 is then ejected from the molding core. A projection can be provided in the center mold plate to form the inclined groove 39 which creates the hinge 37. Because the projection will be inclined only slightly to the axis of movement of the molded cap during ejection, the molded cap can be withdrawn over the projection and it is not necessary to provide a slidable insert in the center said plate.

I claim:

1. A dispensing cap for a container including:

a tubular body of circular transverse cross section, a wall closing the top end of the tubular body, an upwardly opening slot formed in the top end wall and extending across the tubular body with a generally flat wall forming the bottom of the slot, an aperture extending through the bottom of the slot into an area surrounded by the tubular body, a hinge assembly located in the slot and including an upstanding member formed on the flat bottom wall of the slot at a location inwardly of the circular perimeter of the tubular body, a flap integrally connected to the upstanding member of the hinge assembly by a strap, a portion of reduced thickness formed in the strap to create a hinge at the juncture of the strap and the upstanding member to permit the flap to swing into and out of the slot to close and open the aperture into the tubular body, the portion of reduced thickness of the strap formed by an inclined slot cut in the tubular body near the top end wall and extending into the upstanding member.

2. The dispensing cap of claim 1 including at least one inclined ramp formed on the upstanding member and at least one projection formed on the flap, the projection having a flat inclined surface near the outer end thereof, the inclined ramp on the upstanding member and the projection being aligned so that when the flag is swung towards and away from its closed position, the flat inclined surface on the projection will engage the inclined ramp on the upstanding member only during a predetermined arc of its travel to thereby retard the flap from movement during that predetermined arc.

3. The dispensing cap of claim 2 in which an inclined ramp is located on the upstanding member at each end of the hinge and corresponding projections are formed on the flap in alignment therewith.

4. The dispensing cap of claim 1 in which the hinge is positioned to extend as a chord to the outer periphery of the tubular body.

* * * * *